US005176705A

United States Patent [19]

Noble

[11] Patent Number: 5,176,705

[45] Date of Patent: Jan. 5, 1993

[54] MEDICATION DISPENSING PACIFIER

[76] Inventor: David E. Noble, 720 Centennial Ave., Sewickley, Pa. 15143

[21] Appl. No.: 818,348

[22] Filed: Jan. 9, 1992

[51] Int. Cl.[5] ..... A61J 7/00; A61J 17/00

[52] U.S. Cl. ..... 606/236; 606/234; 606/235; 215/11.1

[58] Field of Search ..... 215/11.1-11.6; 606/234-236; 604/77

[56] References Cited

U.S. PATENT DOCUMENTS

| | | | |
|---|---|---|---|
| 635,226 | 10/1899 | Borcher | 606/236 |
| 2,612,165 | 9/1952 | Szuderski . | |
| 2,824,561 | 2/1958 | Mueller . | |
| 2,889,829 | 6/1959 | Tannenbaum et al. . | |
| 3,077,279 | 2/1963 | Mitchell | 215/11.1 |
| 4,192,307 | 3/1980 | Baer . | |
| 4,324,249 | 4/1982 | Sundkvist et al. | 606/236 |
| 4,481,949 | 11/1984 | Kesselring et al. | 606/236 |
| 4,554,919 | 11/1985 | Hubert | 606/234 |
| 4,796,628 | 1/1989 | Anderson | 606/236 |
| 4,867,159 | 9/1989 | Fulton | 606/236 |
| 4,959,051 | 9/1990 | Glass et al. | 606/234 |
| 5,013,321 | 5/1991 | MacVane | 606/234 |
| 5,078,734 | 1/1992 | Noble | 606/236 |

FOREIGN PATENT DOCUMENTS

| | | | |
|---|---|---|---|
| 0903008 | 9/1945 | France | 606/236 |
| 0561251 | 4/1957 | Italy | 606/236 |
| 0003666 | of 1913 | United Kingdom | 606/236 |

*Primary Examiner*—Stephen C. Pellegrino
*Assistant Examiner*—Glenn Dawson
*Attorney, Agent, or Firm*—Webb, Burden, Ziesenheim & Webb

[57] ABSTRACT

An infant's pacifier is constructed in a manner to confine and administer a beneficial liquid composition. The pacifier has a hollow nipple having at its open upper extremity an outwardly directed flange. The nipple is held within a cylindrical sleeve centered in a base panel. The flange rests in abutment with a flat terminal rim of the sleeve. The sleeve is threadably engaged by a cap having a closure panel adapted to compress the flange against the flat rim, thereby sealing the nipple in a fluid-impermeable manner. The closure panel has provision for admitting a controlled amount of air to the nipple.

4 Claims, 2 Drawing Sheets

MEDICATION DISPENSING PACIFIER

RELATED APPLICATIONS

This application is directed to an improved medication dispensing pacifier of the type disclosed in U.S. patent application Ser. No. 07/600,700, filed Oct. 22, 1990, now U.S. Pat. No. 5,078,734.

BACKGROUND OF THE INVENTION

This invention relates to infant pacifiers, and more particularly concerns a pacifier adapted to deliver medication or nutritional substances to infants through a sucking action.

Pacifiers are made according to various types and are usually nipple-shaped. They are used to appease crying children or to discourage thumb-sucking and other idiosyncrasies. Very often the pacifier is dipped in honey, syrup, or topical oral medication to tranquilize the infant. Unfortunately, the effect is only short-lived, for the dipped coating is rapidly diluted by saliva, and the pacifier has to be dipped repeatedly.

It is generally difficult to orally administer to babies and infants medicines or vitamins, particularly those having unpleasant taste or aroma. Various container type porous and non-porous pacifiers have been disclosed in the prior art which provide containment and delivery means for medication or nutritious substances. For example, U.S. Pat. Nos. 2,889,829; 4,192,307; 2,612,165; and 2,824,561 disclose numerous embodiments of pacifiers characterized by having perforated or microporous hollow nipples and containment means for viscous liquid medications or nutrients. The liquid is dispensed from said containment means and drawn through the nipple by the suckling of the infant.

Such pacifiers, although adapted for the administration of medicines generally in liquid form, do not provide for the accurate measuring of the dosage of such medicines. Furthermore, the filling of the containment reservoir is often difficult, and spillage and waste of medicine occurs. Some medications must be administered in accurate doses. In the case of a microporous nipple, the suckling of the infant will collapse the nipple and not allow the infant to ingest a complete dosage.

It is therefore an object of the present invention to provide a reservoir type pacifier which may be easily and accurately filled with a specific dosage of medicine.

It is another object of this invention to provide a pacifier of the aforesaid nature which will alternatively accommodate a prepackaged unit dosage of medication.

It is a yet another object of the present invention to provide a pacifier of the aforesaid nature which will not collapse due to the suckling of an infant.

It is a further object of this invention to provide a pacifier of the aforesaid nature amenable to easy cleaning and sterilization.

These objects and other objects and advantages of the invention will be apparent from the following description.

SUMMARY OF THE INVENTION

The above and other beneficial objects and advantages are accomplished in accordance with the present invention by a pacifier adapted for the containment and administration of liquid medication, said pacifier comprised of:

a) a hollow, elongated nipple having an interior reservoir bounded in part by closed distal and open proximal extremities, said nipple constructed of elastic material and having an axis of symmetry extending between said extremities, and measuring indicia orthogonal to said axis at spaced intervals between the extremities, said proximal extremity having a circular mounting flange outwardly directed with respect to said axis, b) a base comprised of a base panel disposed orthogonally to said axis, and having a forward surface that faces said nipple and an opposed rear surface, an aperture of circular perimeter substantially centered within said base panel upon said axis, and a circular cylindrical sleeve emergent from said rear surface in coaxial relationship with said axis and having annular sealing means configured to abut with the mounting flange of said nipple, said sleeve having interior and exterior surfaces, one of said surfaces being threaded, c) a cap of cup-like configuration comprised of a cylindrical sidewall configured and threaded to engage the threaded surface of said sleeve, said sidewall having front and rear extremities, and a closure panel spanning said sidewall a said rear extremity, and d) a handling ring rearwardly emergent from said closure panel, whereby e) when said cap is threadably tightened upon said sleeve, the mounting flange of the nipple becomes compressed between said sealing means and cap, thereby sealing the proximal extremity of the nipple in a fluid impermeable manner.

In preferred embodiments, the cap may have means for admitting controlled amounts of air to compensate for the amount of liquid removed from the nipple during use. The base panel has a perimeter that extends from the center axis by a distance not more than about the length of said nipple. The base panel may have holes therein for air passage.

The base is preferably of monolithic construction, fabricated of plastic by a molding operation. The handling ring may be pivotably attached to the closure panel.

The nipple is preferably constructed of non-porous elastomeric material, and may have one or more small delivery holes in the distal extremity to permit removal of fluid contained within the nipple. In other embodiments, the nipple may function as a disposable packaging means for a medication, and may be punctured at the time of use. In other applications, the nipple may contain a freezable liquid which serves to sooth the gums of teething infants.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
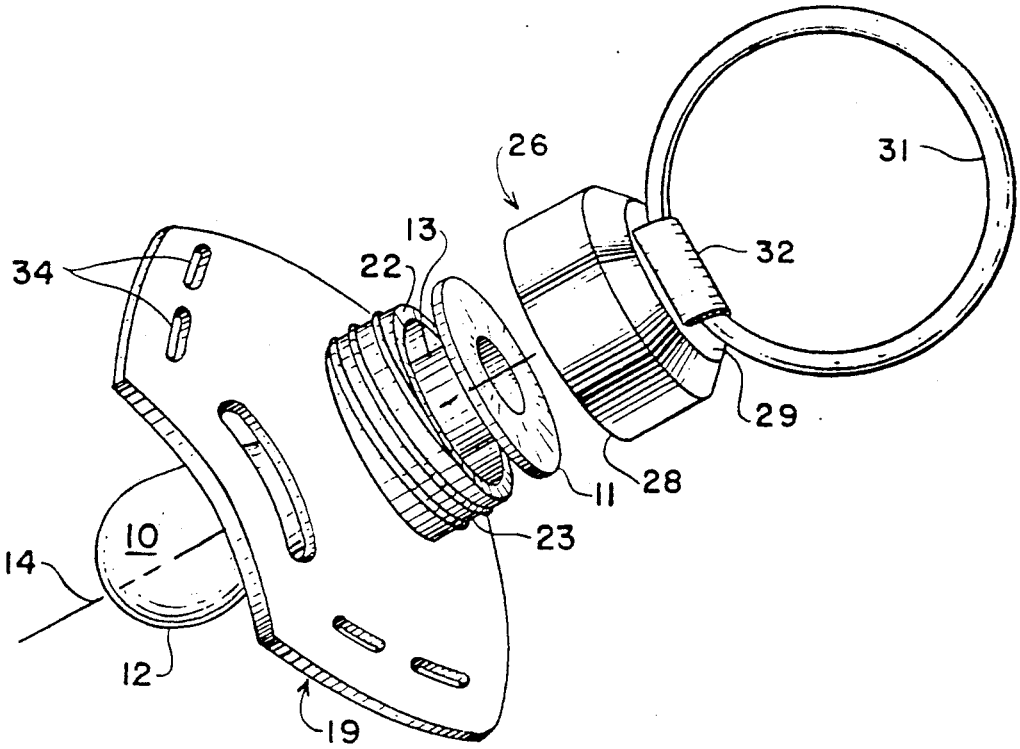
FIG. 1 is an exploded perspective view of an embodiment of the pacifier of the present invention.
Figure 2:
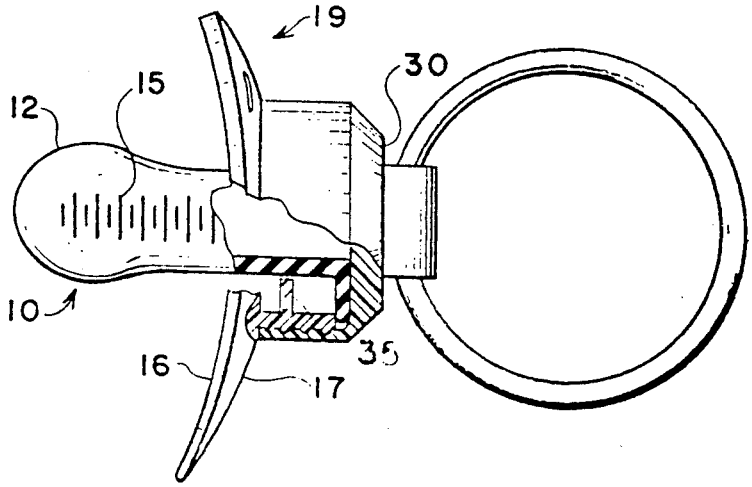
FIG. 2 is a side view of the embodiment of FIG. 1 with portions broken away to show interior details.
Figure 4:
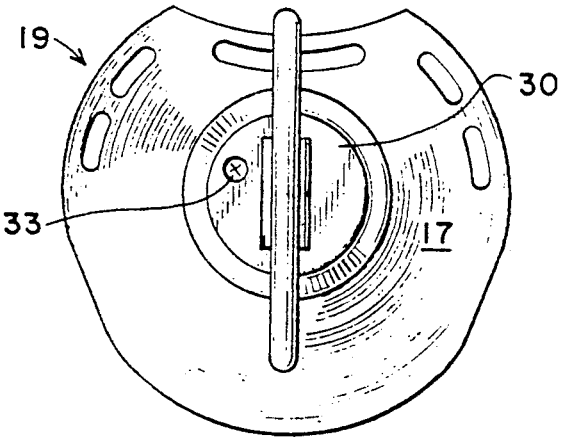
FIG. 4 is a rear end view.
Figure 3:
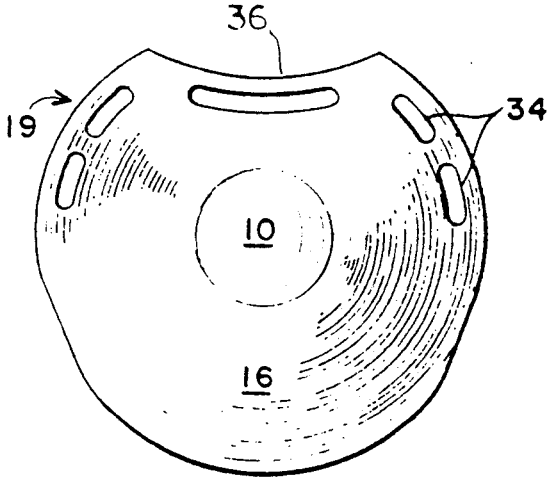
FIG. 3 is a forward end view.
Figure 5:
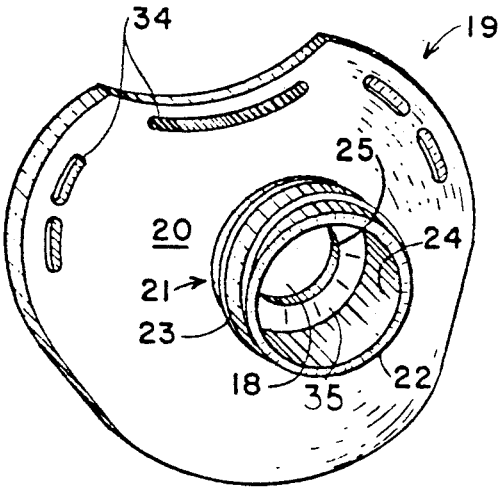
FIG. 5 is a perspective rear view of the base component.
Figure 6:
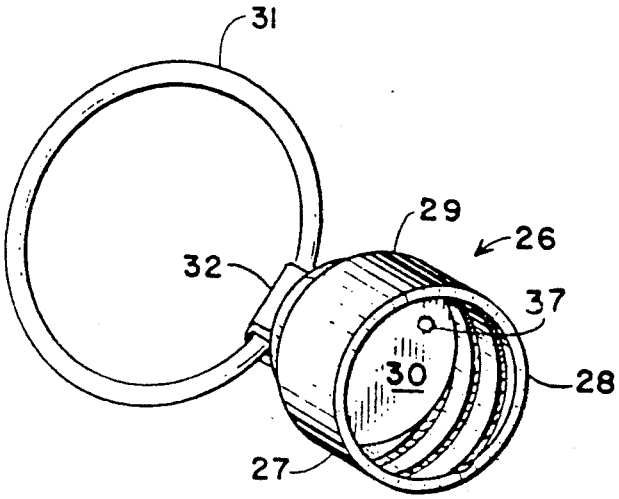
FIG. 6 is a perspective front view of the cap component.

Referring to FIGS. 1-6, an embodiment of the apparatus of the present invention is shown comprised of a pacifier adapted for the containment and administration of liquid medication. The pacifier is comprised of hollow, elongated nipple 10 bounded in part by closed distal and open proximal extremities 12 and 13, respectively. Nipple 10 is constructed of microporous translucent elastic material and has an axis of symmetry 14 extending between extremities 12 and 13. Proximal extremity 13 is provided with a circular flat mounting flange 11 extending outwardly from extremity 13 as a continuous integral extension thereof. In other embodiments, the mounting flange may be in the form of a rolled lip.

Base 19 is comprised of base panel 20 disposed substantially orthogonally to said axis 14. Base panel 20 has a forward surface 16 that faces said nipple, and an opposed rear surface 17. Holes 34 may be disposed in base panel 20 to facilitate breathing by the infant, and an upper indentation 36 may be present to accommodate the infant's nose. An aperture 18 of circular perimeter 25 is substantially centered within said base panel upon axis 14. A circular cylindrical sleeve 21 is emergent from rear surface 17 in coaxial relationship with axis 14, and terminates in annular sealing means in the form of flat rim 22 spaced and dimensioned so as to abut with mounting flange 11 of nipple 10 which extends through said aperture and sleeve. Said sleeve has a threaded exterior surface 23 and an interior surface 24 which constitutes a continuous smooth projection of perimeter 25 of aperture 18. Alternative annular sealing means may be present in the form of positioning shelf 35 disposed upon interior surface 24. Shelf 35 would be interactive with the aforesaid type of nipple wherein the mounting flange is a rolled lip. In other embodiments, sleeve 21 may be equipped with a sealing O-ring positioned on exterior surface 23 adjacent base panel 20.

Cap 26, of cup-like shape, is comprised of interiorly threaded circular cylindrical sidewall 27 having front and rear extremities 28 and 29, respectively, and configured to engage exterior surface 23 of sleeve 21. If sleeve 21 is threaded on its inside surface, then the exterior surface of the cap would be threaded, and its front extremity 28 would abut against flange 11 on shelf 35. Closure panel 30 spans sidewall 27 at rear extremity 29, and may contain a perforation and associated valve mechanism 33 for passage of controlled amounts of air. One type of valve mechanism that may be used is a slit rubber sheet. Another type of valve is a ball-type check valve. Still other types of valves may be employed.

A handling ring 31 is attached by holding loop 32 to closure panel 30 in a manner permitting pivotal movement of said ring about said loop.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A pacifier adapted for the containment and administration of liquid medication to an infant, said pacifier comprising:

a) a hollow, elongated nipple having an interior reservoir bounded in part by closed distal and open proximal extremities, said nipple constructed of elastic material and having an axis of symmetry extending between said extremities, and measuring indicia orthogonal to said axis at spaced intervals between said extremities, said proximal extremity having a circular mounting flange outwardly directed with respect to said axis, b) a base comprised of a base panel disposed substantially orthogonally to said axis, and having a forward surface that faces said closed distal extremity of said nipple and an opposed rear surface, an aperture of circular perimeter substantially centered within said base panel upon said axis, and a circular cylindrical sleeve emergent from said rear surface in coaxial relationship with said axis and having annular sealing means configured to abut with the mounting flange of said nipple, said sleeve having an interior surface and an exterior surface, said exterior surface being threaded, c) a cap of cup-like configuration including a sidewall having an interior threaded surface configured to engage the exterior threaded surface of said sleeve, said sidewall having front and rear extremities, and a closure panel spanning said sidewall at said rear extremity, and d) a handling ring rearwardly emergent from said closure panel, whereby e) when said cap is threadably tightened upon said sleeve, the mounting flange of the nipple becomes compressed between said sealing means and cap, thereby sealing the proximal extremity of the nipple in a fluid impermeable manner.

2. The pacifier of claim 1 wherein the closure panel of said cap contains a perforation for the passage of air.

3. The pacifier of claim 2 wherein a valve is associated with said perforation to control the amount of air that may pass through said perforation.

4. The pacifier of claim 1 wherein said base panel contains holes to facilitate breathing by said infant, and an indentation which accommodate's the infant's nose.

* * * * *